US007655612B2

(12) United States Patent
Zak

(10) Patent No.: US 7,655,612 B2
(45) Date of Patent: Feb. 2, 2010

(54) LAUNDRY WRINKLE CONTROL COMPOSITION

(75) Inventor: Henry Zak, Little Falls, NJ (US)

(73) Assignee: Arvotec LLC, Little Falls, NJ (US)

( * ) Notice: Subject to any disclaimer, the term of this patent is extended or adjusted under 35 U.S.C. 154(b) by 0 days.

(21) Appl. No.: 11/691,797

(22) Filed: Mar. 27, 2007

(65) Prior Publication Data

US 2007/0232518 A1 Oct. 4, 2007

Related U.S. Application Data

(60) Provisional application No. 60/787,375, filed on Mar. 30, 2006.

(51) Int. Cl.
*C11D 1/83* (2006.01)

(52) U.S. Cl. ..... 510/470; 510/513

(58) Field of Classification Search ..... 510/470, 510/513

See application file for complete search history.

(56) References Cited

U.S. PATENT DOCUMENTS

| | | | | |
|---|---|---|---|---|
| 5,532,023 | A | 7/1996 | Vogel et al. | |
| 6,306,813 | B1 * | 10/2001 | Suzuki | 510/392 |
| 6,613,733 | B1 | 9/2003 | Barnabas et al. | |
| 6,916,774 | B2 | 7/2005 | Trinh et al. | |
| 7,012,053 | B1 * | 3/2006 | Barnabas et al. | 510/287 |
| 7,041,630 | B1 | 5/2006 | Trinh et al. | |
| 7,462,236 | B2 * | 12/2008 | Chun et al. | 106/729 |
| 2002/0151451 | A1 | 10/2002 | Barnabas et al. | |
| 2003/0139309 | A1 | 7/2003 | Brockett et al. | |
| 2008/0199918 | A1 * | 8/2008 | Viksoe-Nielsen et al. | 435/101 |
| 2008/0293607 | A1 * | 11/2008 | Jones et al. | 510/226 |

FOREIGN PATENT DOCUMENTS

| | | | |
|---|---|---|---|
| EP | 1201816 | A1 | 5/2002 |
| EP | 1201817 | A1 | 5/2002 |
| WO | WO97/23683 | A1 | 7/1997 |
| WO | WO98/38288 | A1 | 9/1998 |
| WO | WO98/49387 | A1 | 11/1998 |
| WO | WO00/24851 | A3 | 5/2000 |
| WO | WO00/24853 | A2 | 5/2000 |
| WO | WO00/24856 | A1 | 5/2000 |
| WO | WO00/24857 | A2 | 5/2000 |
| WO | WO00/24858 | A1 | 5/2000 |
| WO | WO00/65014 | A1 | 11/2000 |
| WO | WO01/07556 | A1 | 2/2001 |
| WO | WO03/055966 | A1 | 7/2003 |

* cited by examiner

*Primary Examiner*—John R Hardee
(74) *Attorney, Agent, or Firm*—Fox Rothschild LLP

(57) ABSTRACT

A laundry additive for removing or reducing wrinkles in fabrics, which contains a wrinkle removing or reducing component, which includes a saccharide or oligosaccharide, a polyhydroxy carboxylic acid compound, and an optional chelating agent; and one or more optional ingredients that do not remove or reduce wrinkles. Also presented is a method for removing or reducing wrinkles from fabrics including the step of contacting the fabrics with an aqueous solution or suspension of an effective amount of the laundry additive.

17 Claims, No Drawings

LAUNDRY WRINKLE CONTROL COMPOSITION

CROSS-REFERENCE TO RELATED APPLICATIONS

This application claims priority to U.S. Provisional Application Ser. No. 60/787,375, which was filed on Mar. 30, 2006, the disclosure of which is incorporated herein by reference.

BACKGROUND OF THE INVENTION

Consumers commonly judge the desirability and wearability of a garment by many appearance criteria, such as, the absence of wrinkles. However, fabric, especially cellulose-based fabric, inter alia, cotton, has a propensity to wrinkle either upon drying after the laundry process or when worn.

Permanent press finishes have been used to provide a crisp, smooth garment, however, permanent press processes must modify the fabric itself, either by cross linking of the cellulose fiber or by applying a less flexible coating material. The breathability, especially of cotton, is sacrificed if the applied coating or crosslinking fills the interstices of the fiber cells. For natural fiber, inter alia, cotton, most coatings must be chemically reacted with the fabric fiber itself in order to obtain the desired level of anti-wrinkle properties. This type of treatment also can occur during the synthesis of polyester fabrics as well. To achieve controlled deposition, there must be an affinity for a fabric surface and the ability of a substrate to lie down onto the garment surface is key to achieving and maintaining a smooth fabric surface.

However, it is preferable that anti-wrinkle benefits are provided via simple and convenient consumer compositions, methods, and products to be applied in the consumer's home. These consumer compositions and products are preferably safe, and do not involve complicated and/or unsafe treatments and/or applications. Desirably they comprise treatments that are familiar to the consumers, such as soaking, dipping, pre-wash treatment, adding to the wash cycle, and/or adding to the rinse cycle.

There is, therefore, a long felt need in the art for a fabric treatment system which provides anti-wrinkle benefits to fabric, and which is convenient for consumer use. This need is met by the present invention.

SUMMARY OF THE INVENTION

A laundry additive for removing or reducing wrinkles in fabrics is presented, wherein the additive contains from about 5 to about 100% by weight of wrinkle removing or reducing component. The wrinkle removing or reducing component includes from about 5 to about 95% by weight of a saccharide or oligosaccharide having a degree of polymerization between 1 and about 200; and from about 5 to about 95% by weight of a polyhydroxy carboxylic acid compound. The additive further includes from 0 to about 50% by weight of a chelating agent; and from 0 to about 95% by weight of one or more ingredients that do not remove or reduce wrinkles.

In one embodiment, the saccharide or oligosaccharide is lactose, maltodextrin, or maltitol. In another embodiment, the polyhydroxy carboxylic acid compound is a sugar acid sequestering agent. In yet another embodiment, the chelating agent is selected from aminocarboxylates, aminophosphonates, ethylenediaminetetraacetic acid (EDTA), nitrilotriacetic acid (NTA), hydroxyethyl ethylenediamine triaceticacid (HE DTA), diethylenetriaminepentaacetic acid (DTPA), citrates, polyacrylic acid, and mixtures thereof, and their salts, and mixtures thereof. In a further embodiment, the one or more ingredients that do not remove or reduce wrinkles are selected from those set out in WO 00/24851, the disclosure of which is incorporated herein by reference in its entirety.

In one embodiment, the composition is a dry, free-flowing powder.

In another embodiment, the composition is an aqueous solution or suspension of the wrinkle removing or reducing component that includes a saccharide or oligosaccharide, the polyhydroxy carboxylic acid compound, the optional chelating agent, and the one or more optional ingredients that do not remove or reduce wrinkles in a solvent, which contains water. In an additional embodiment, the solvent further includes a polar solvent, such as ethanol, propanol, isopropanol, or a mixture thereof.

In one embodiment, the composition is an aqueous solution or suspension of the wrinkle removing or reducing component, the polyhydroxy carboxylic acid compound, the optional chelating agent, and the one or more optional ingredients that do not remove or reduce wrinkles in a solvent consisting of water.

Also provided is a method for removing or reducing wrinkles from fabrics by contacting the fabrics with an aqueous solution or suspension of an effective amount of the additive of the present invention.

In one embodiment, the contacting step adds the additive to water used in a laundry pre-soak, wash, or rinse cycle.

In another embodiment, the one or more optional ingredients that do not remove or reduce wrinkles comprise laundry detergent components.

DETAILED DESCRIPTION OF THE INVENTION

The present invention relates to a laundry additive for removing or reducing wrinkles in fabrics. Also disclosed are methods of removing or reducing wrinkles from fabrics using the laundry additive.

The laundry additive of the present invention contains from about 5 to 100%, preferably from about 50 to about 100%, by weight of a wrinkle removing or reducing component. This component contains from about 5 to about 95% by weight of a saccharide or oligosaccharide having a degree of polymerization between 1 and about 200.

Suitable saccharides or oligosaccharides include oligosaccharides with a degree of polymerization (DP) from about 1 to about 200, preferably from about 2 to about 100, and wherein each monomer is selected from a reducing saccharide containing 5 and/or 6 carbon atoms, including isomaltose, isomaltotetraose, isomaltooligosaccharide, fructooligosaccharide, levooligosaccharides, galactooligosaccharide, xylooligosaccharide, gentiooliogosaccharides, disaccharides, glucose, fructose, galactose, xylose, mannose, arabinose, rhamnose, maltose, α-maltose, β-maltose, sucrose, lactose, α-lactose, β-lactose, α-cellobiose, β-cellobiose, maltulose, ribose, lyxose, allose, altrose, gulose, idose, talose, trehalose, nigerose, kojibiose, lactulose, oligosaccharides, maltooligosaccharides, trisaccharides, tetrasaccharides, pentasaccharides, hexasaccharides, oligosaccharides from partial hydrolysates of natural polysaccharide sources, higher saccharides, such as maltotriose and maltotetrose, higher sugar alcohols such as maltitol, lower molecular weight starch hydrolysates derived from corn, wheat, potato, rice, tapioca, sorghum, and arrowroot, lower molecular weight cellulose hyrolysates, complexes thereof, including aluminum complexes, boron complexes, zeolite complexes, ether and ester derivatives thereof, hydroxyl oxidation products thereof, hydrogenated derivatives thereof, and the like, and mixtures thereof.

The wrinkle removing or reducing component additive also includes from about 5 to about 95% by weight of a polyhydroxy carboxylic acid compound. Examples of polyhydroxy carboxylic acid compounds include sugar acid sequestering agents. Suitable sugar acid sequestering agents include sodium gluconate, sodium glucoheptonate, sodium saccharate, α-sodium glucoheptonate, α-sodium glucoheptonate dihydrate, β-sodium glucoheptonate, α,β-glucoheptonate mixtures, 2-keto sodium gluconate, 5-keto sodium gluconate, sodium fructoheptonates, carboxylic acid derivates thereof, ester and ether derivates thereof, non-sodium salts thereof, and the like, and mixtures thereof.

The wrinkle removing additive or component further contains from 0 to about 50% by weight of a chelating agent. When present, a chelating agent level between about 1 and about 25% by weight is preferred. Suitable chelating agents include aminocarboxylates, aminophosphonates, ethylenediaminetetraacetic acid (EDTA), nitrilotriacetic acid (NTA), hydroxyethyl ethylenediamine triaceticacid (HE DTA), diethylenetriaminepentaacetic acid (DTPA), citrates, polyacrylic acid, and mixtures thereof, and their salts, and mixtures thereof.

The ratio of saccharide or oligosaccharide to polyhydroxy carboxylic acid compound is between about 90:10 and 10:90 and more preferably is between about 80:20 and 20:80. A ratio between about 75:25 and 25:75 is even more preferred.

Additionally, the laundry additive of the present invention contains from 0 to about 95% by weight of one or more ingredients that do not remove or reduce wrinkles. Useful ingredients are those that are compatible with the wrinkle removing or reducing component, in that they do not interfere with and/or substantially or significantly diminish the benefits provided by the wrinkle removing or reducing component. Examples of such ingredients include laundry detergent agents, shape retention polymers, hydrophilic plasticizers, surfactants, odor control agents, perfumes, antimicrobial actives, antimicrobial preservatives, fabric softening actives, electrolytes, phase stabilizers, auxiliary whiteness preservatives, water-soluble polyionic polymers, antistatic agents, insect and/or moth repelling agents, colorants, builders, bleaching agents, dye transfer inhibiting agents, chlorine scavenging agents, polymeric soil release agents, dye fixing agents, dispersants, enzymes, heavy metal chelating agents, suds suppressors, and the like. Specific examples of these ingredients are provided in WO 00/24851, the disclosure of which is incorporated herein by reference in its entirety.

Suitable forms of the laundry additive include a powder, an aqueous solution, a form suitable for spraying, which contains a propellant, and a suspension of the dry components of the laundry additive in a solvent, which contains water. In addition to water, the solvent may further contain water-soluble solvents, such as, ethanol, propanol, isopropanol, ethylene glycol, glycerol, and the like, and mixtures thereof.

Also presented is a method for removing or reducing wrinkles from fabrics including the step of contacting the fabrics with an aqueous solution or suspension of an effective amount of the laundry additive of the present invention.

The contacting step can further include adding the additive to water used in a laundry pre-soak, wash, or rinse cycle.

The present invention is further illustrated by the following examples that teach those of ordinary skill in the art how to practice the invention. The following examples are merely illustrative of the invention and disclose various beneficial properties of certain embodiments of the invention. The following examples should not be construed as limiting the invention as claimed.

EXAMPLES

TABLE I

| | Conditions for washing laundry | | | | |
|---|---|---|---|---|---|
| | Composition (% by weight) | Composition (grams per washload) | Water Temperature | Dryer Temperature | Detergent |
| Example 1 | 80% lactose<br>20% sodium gluconate | 115 g | Warm | Warm | Dynamo ® |
| Example 2 | 75% 55 DE corn syrup solids<br>25% sodium glucoheptonate•$2H_2O$ | 135 g | Cold | Warm | Purex ® |
| Example 3 | 70% maltodextrin<br>15% sodium gluconate<br>15% EDTA | 120 g | Hot | Warm | Wisk ® |
| Example 4 | 85% maltitol<br>15% sodium boroglucoheptonate | 130 g | Warm | Warm | XTRA ® |
| Example 5 | 81% maltodextrin<br>16% sodium saccharate<br>3% HE EDTA 3Na | 120 g | Cold | Warm | FAB ® |
| Example 6 | 40% maltitol<br>38% lactose<br>12% potassium gluconate - zeolite complex<br>10% DTPA 5Na | 135 g | Hot | Warm | YES ® |
| Example 7 | 40% maltodextrin A<br>40% maltodextrin B<br>20% sodium gluconate | 130 g | Warm | Warm | Tide ® |

Example 1

A composition containing 80% by weight lactose and 20% by weight sodium gluconate was added to a wash cycle under the conditions shown in Table I. The laundry items included: 100% cotton shirts, pants, shorts, and towels; cotton-polyester shirts, sweater, pants, and socks; a polyester-nylon blouse;

and cotton jeans. Following the washing and drying cycles, the fabrics were wrinkle-free, smooth, soft, and static free.

Example 2

A composition containing 75% by weight 55 DE corn syrup solids and 25% by weight sodium glucoheptonate $.2H_2O$ was added to a wash cycle under the conditions shown in Table I. The laundry items included: 100% cotton shirts, pants, underwear, and blouse; cotton-polyester shirts and shorts; and cotton-nylon blouses, socks, and light jacket. Following the washing and drying cycles, the fabrics were soft and static free. Only the cotton shirts needed touch-up ironing.

Example 3

A composition containing 70% by weight maltodextrin (7.4% glucose, maltose; 48.8% D.P. 3-10; 43.8% D.P. 10+), 15% by weight sodium gluconate, and 15% by weight EDTA was added to a wash cycle under the conditions shown in Table I. The laundry items included: 100% cotton t-shirts, pants, underwear, and socks; and cotton-polyester sweater, shirts, and towels. Following the washing and drying cycles, the fabrics were soft and static free. Only some of the cotton shirts needed touch-up ironing.

Example 4

A composition containing 85% by weight maltitol and 15% by weight sodium boroglucoheptonate was added to a wash cycle under the conditions shown in Table I. The laundry items included: 100% cotton polo shirts, pants, and shirts; cotton-polyester blouses, skirts, and lingerie; and a cotton-nylon jacket. Following the washing and drying cycles, the fabrics were soft and static free. Only the 100% cotton fabrics needed touch-up ironing.

Example 5

A composition containing 81% by weight maltodextrin (1.6% glucose, maltose; 10.6% D.P. 3-10; 87.8% D.P. 10+), 16% by weight sodium saccharate, and 3% HE EDTA 3Na was added to a wash cycle under the conditions shown in Table I. The laundry items included: 100% cotton shirts, jeans, and towels; cotton-polyester polo shirts, blouses, and shirts; cotton-nylon pants and socks; and rayon-polyester skirt and shirt. Following the washing and drying cycles, the fabrics were soft and static free. Only some of the 100% cotton shirts needed touch-up ironing. No ironing was required for synthetics.

Example 6

A composition containing 40% by weight maltitol, 38% by weight lactose, 12% by weight potassium gluconate—zeolite complex, and 10% by weight DTPA 5Na was added to a wash cycle under the conditions shown in Table I. The laundry items included 100% cotton white shirts, t-shirts, slacks, socks, underwear, and sheets. Following the washing and drying cycles, the fabrics were soft and static free and required no ironing.

Example 7

A composition containing 40% by weight maltodextrin A (7.4% glucose, maltose; 48.8% D.P. 3-10; 43.8% D.P. 10+), 40% by weight maltodextrin B (1.6% glucose, maltose; 10.6% D.P. 3-10; 87.8% D.P. 10+), and 20% by weight sodium gluconate was added to a wash cycle under the conditions shown in Table I. The laundry items included cotton/polyester shirts and pants, 100% cotton shirts and pants, and jeans. Following the washing and drying cycles, the fabrics were soft and static free. No ironing was required.

TABLE II

| Location of testing site | Wrinkle Control Benefit | |
|---|---|---|
| | Wrinkle Control Benefit | |
| | Composition A | Composition B |
| Irvine, CA | None | Very Good |
| Tucson, AZ | None | Excellent |
| Salt Lake, UT | None | Excellent |
| Denver, CO | None | Excellent |
| Seattle, WA | Minor | Very Good |
| Boca Raton, FL | None | Very Good |
| Cleveland, OH | None | Excellent |
| Riverhead, NY | None | Very Good |
| Mountainside, NJ | None | Excellent |

Example 8

Wrinkle control benefits of compositions containing lactose (Composition A) were compared with compositions containing lactose and sodium gluconate (Composition B) in various U.S. geographical areas (Table II). Tested fabrics were selected from 100% cotton, cotton/polyester blends, polyester/nylon, rayon, and acrylic. Tested laundry items were selected from shirts, pants, jeans, tees, bed sheets, towels, socks, and underwear.

As shown in Table II, the saccharide/polyhydroxy carboxylic acid compound composition (Composition B) provided positive wrinkle control benefits characterized as "very good" or "excellent." By contrast, the saccharide composition (Composition A) provided little to no wrinkle control benefits characterized as "minor" or "none."

What is claimed is:

1. A laundry additive for removing or reducing wrinkles in fabrics consisting of from about 5 to about 100% by weight of wrinkle removing or reducing component consisting of:

from about 5 to about 95% by weight of a saccharide or oligosaccharide selected from the group consisting of lactose, glucose, maltose, sucrose, 55 DE corn syrup solids, maltodextrins, maltitol, α-cellobiose, β-cellobiose, lower molecular weight starch hydrolysates derived from corn, wheat, potato, rice, tapioca, sorghum, or affowroot, lower molecular weight cellulose hyrolysates, monosaccharides, disaccharides, trisaccharides, tetrasaccharides, pentasaccharides, complexes thereof, aluminum complexes thereof, boron complexes thereof, zeolite complexes thereof, ether and ester derivatives thereof, hydroxyl oxidation products thereof, hydrogenated derivatives thereof, and mixtures thereof;

from about 5 to about 95% by weight of a sugar acid sequestering agent selected from the group consisting of sodium gluconate, sodium glucoheptonate, sodium saccharate, α-sodium glucoheptonate, α-sodium glucoheptonate dihydrate, β-sodium glucoheptonate, α,β-glucoheptonate mixtures, 2-keto sodium gluconate, 5-keto sodium gluconate, sodium fructoheptonates, carboxylic acid derivates thereof, boron complexes thereof, zeolite complexes thereof, ester and ether derivates thereof, non-sodium salts thereof, and mixtures thereof; and from 0 to about 50% by weight of a chelating agent;

wherein said laundry additive optionally consists of:

from 0 to about 95% by weight of one or more ingredients that do not remove or reduce wrinkles selected from the group consisting of laundry detergent agents, hydrophilic plasticizers, surfactants, odor control agents, perfumes, antimicrobial actives, antimicrobial preservatives, electrolytes, phase stabilizers, auxiliary whiteness preservatives, water-soluble polyionic polymers, antistatic agents, insect repelling agents, moth repelling agents, colorants, builders, bleaching agents, dye transfer inhibiting agents, chlorine scavenging agents, polymeric soil release agents, dye fixing agents, dispersants, enzymes, suds suppressors, solvents, and mixtures thereof.

2. The additive of claim 1, wherein the saccharide or oligosaccharide is selected from the group consisting of lactose, maltodextrin, and maltitol.

3. The additive of claim 2, wherein the sugar acid sequestering agent is selected from the group consisting of sodium gluconate and α-sodium glucoheptonate dihydrate.

4. The additive of claim 1, wherein the sugar acid sequestering agent is selected from the group consisting of sodium gluconate and α-sodium glucoheptonate dihydrate.

5. The additive of claim 1, wherein the chelating agent is selected from the group consisting of aminocarboxylates, aminophosphonates, ethylenediaminetetraacetic acid (EDTA), nitrilotriacetic acid (NTA), hydroxyethyl ethylenediamine triaceticacid (HE DTA), diethylenetriaminepentaacetic acid (DTPA), citrates, polyacrylic acid, mixtures thereof, their salts, and mixtures thereof.

6. The additive of claim 1, wherein the saccharide or oligosaccharide is selected from the group consisting of lactose, lower molecular weight starch hydrolysates derived from corn, maltodextrin, maltitol, and mixtures thereof.

7. The additive of claim 1, wherein the composition is a dry, free-flowing powder.

8. The additive of claim 1, wherein the solvent is selected from the group consisting of water, water and ethanol, water and propanol, and water and isopropanol.

9. The additive of claim 8, wherein the composition is an aqueous solution or suspension in a solvent consisting of water.

10. A method for removing or reducing wrinkles from fabrics comprising contacting said fabrics with an aqueous solution or suspension of an effective amount of the additive of claim 1.

11. The method of claim 10, wherein the contacting step comprises adding said additive to water used in a laundry pre-soak, wash, or rinse cycle.

12. The method of claim 10, wherein the one or more ingredients that do not remove or reduce wrinkles consists of laundry detergent agents.

13. The method of claim 10, wherein the saccharide or oligosaccharide is lactose.

14. The method of claim 10, wherein the chelating agent is selected from the group consisting of aminocarboxylates, aminophosphonates, ethylenediaminetetraacetic acid (EDTA), nitrilotriacetic acid (NTA), hydroxyethyl ethylenediamine triaceticacid (HE DTA), diethylenetriaminepentaacetic acid (DTPA), citrates, polyacrylic acid, mixtures thereof, their salts, and mixtures thereof.

15. The method of claim 10, wherein the composition is a dry, free-flowing powder.

16. The method of claim 10, wherein said solution or suspension contains solvent selected from the group consisting of water, water and ethanol, water and propanol, and water and isopropanol.

17. The method of claim 16, wherein the composition is an aqueous solution or suspension in a solvent consisting of water.

* * * * *